US008146517B1

(12) United States Patent
Masser et al.

(10) Patent No.: US 8,146,517 B1
(45) Date of Patent: Apr. 3, 2012

(54) PLATFORM ELEMENTS WITH INTEGRAL STORAGE

(75) Inventors: Jeremy Masser, Fenton, MI (US); Matt Janowak, Fenton, MI (US)

(73) Assignee: Structural Plastics, Inc., Holly, MI (US)

( * ) Notice: Subject to any disclaimer, the term of this patent is extended or adjusted under 35 U.S.C. 154(b) by 687 days.

(21) Appl. No.: 12/265,339

(22) Filed: Nov. 5, 2008

(51) Int. Cl.
*A47B 57/00* (2006.01)

(52) U.S. Cl. ..... 108/64; 108/65; 108/57.26; 108/156

(58) Field of Classification Search ..... 108/64, 108/65, 57.26, 156, 158.11, 901; 248/346.01, 248/346.04, 460, 151, 188.8, 346.06; 24/288, 24/545, 570, 910; 52/220.1, 220.2, 263, 52/177

See application file for complete search history.

(56) References Cited

U.S. PATENT DOCUMENTS 2,613,957 A * 10/1952 Ritter ..... 285/188
3,964,810 A 6/1976 Murphy
4,101,617 A 7/1978 Friederich
4,119,045 A 10/1978 Michelotti
4,656,953 A * 4/1987 Miller, Jr. ..... 108/153.1
4,675,929 A * 6/1987 Santo ..... 5/400
4,815,394 A 3/1989 Ettlinger et al.
5,341,749 A * 8/1994 Noakes ..... 108/64
5,483,899 A * 1/1996 Christie ..... 108/56.3
5,556,181 A * 9/1996 Bertrand ..... 312/313
5,855,424 A 1/1999 Hamilton et al.
6,079,339 A 6/2000 Houk, Jr. et al.
6,085,668 A * 7/2000 Kanki ..... 108/65
6,234,087 B1 * 5/2001 Brown ..... 108/56.1
6,460,471 B1 * 10/2002 Yang ..... 108/156
6,598,542 B2 * 7/2003 Goldberg et al. ..... 108/64
6,908,000 B2 6/2005 Craft et al.
6,976,434 B2 * 12/2005 Roig et al. ..... 108/25
7,334,529 B1 * 2/2008 Liao et al. ..... 108/57.26
7,574,966 B1 * 8/2009 Stephens et al. ..... 108/157.1
7,950,336 B2 * 5/2011 Phillips ..... 108/64
2003/0131766 A1 * 7/2003 Petlakh ..... 108/64
2005/0102936 A1 * 5/2005 Chen et al. ..... 52/263
2009/0114132 A1 * 5/2009 Hsieh ..... 108/156

* cited by examiner

*Primary Examiner* — Janet M Wilkens
*Assistant Examiner* — Daniel Rohrhoff
(74) *Attorney, Agent, or Firm* — Young Basile Hanlon & MacFarlane P.C.

(57) ABSTRACT

A platform element that is connectable to a secondary structure using a clip that is adapted to be installed in a storage position or a use position with respect to the platform element. The platform element includes a substantially planar panel and at least one upstanding wall that extends generally downward from the panel and is adapted to space the panel from an external support surface. The clip is adapted to connect the upstanding wall to the secondary structure when the clip is in the use position. A receptacle is formed on an underside of the panel. The receptacle is adapted to engage the clip to maintain the clip in a fixed position with respect to the panel when the clip is in the storage position.

17 Claims, 5 Drawing Sheets

PLATFORM ELEMENTS WITH INTEGRAL STORAGE

FIELD OF THE INVENTION

The invention relates to the field of platform elements that may be interconnected in a modular platform assembly.

BACKGROUND OF THE INVENTION

In many industrial and commercial work environments, it is desirable to position horizontally-disposed shelving surfaces, work surfaces, and standing surfaces at some height above the floor or other external support surface. Modular shelving units, work surfaces, and standing platforms are well-known and are utilized in numerous ways in both commercial and industrial settings.

Often, shelving surfaces, work surfaces, and standing platforms are formed from strong, lightweight panels that are cast, molded, or otherwise formed from strong, lightweight plastic materials. Such panels may be formed having a continuous surface or may be formed as a grid work, which enables the panels to remain relatively light in weight and high in strength while providing for drainage of liquids through the top surface of the panels.

It is known to provide shelving surfaces, work surfaces, and standing platforms that are modular in construction, wherein individual panels are connected together by fasteners to achieve a desired configuration. Thus, the panels may be reconfigured and redeployed to adapt to changing needs in the commercial or industrial environment in which they are being used. However, the fasteners utilized to interconnect the panels are susceptible to loss when they are not being used. Thus, need remains for a means of preventing loss of fasteners for modular panel assemblies when the fasteners are not in use.

SUMMARY OF THE INVENTION

The invention provides platform elements with integral storage. In one embodiment, the invention provides a platform element that is connectable to a secondary structure using a clip that is adapted to be installed in a storage position or a use position with respect to the platform element. The platform element includes a substantially planar panel and at least one upstanding wall. The upstanding wall extends generally downward from the panel and is adapted to space the panel from an external support surface. The clip is adapted to connect the upstanding wall to the secondary structure when the clip is in the use position. The platform element further includes a receptacle that is formed on an underside of the panel. The receptacle is adapted to engage the clip to maintain the clip in a fixed position with respect to the panel when the clip is in the storage position.

The clip may have a flange formed thereon, and the receptacle may have a pair of fingers, wherein the flange is adapted to frictionally engage the pair of fingers. Alternatively, the receptacle may have a channel, wherein the flange is adapted to frictionally engage the channel. Furthermore, the receptacle may have a tube that is connected to the underside of the panel, wherein the clip is adapted to be disposed within the tube. Additionally, the receptacle may be adapted to receive a leg therein to space the upstanding walls of the first platform element from the external support surface.

The upstanding wall of the platform element may have a lower edge that is adapted to engage the external support surface. Furthermore, the upstanding wall may have a notch formed along the lower edge thereof to define a notch edge that is spaced from the external support surface when the lower edge is engaged with the external support surface, wherein the clip is extendable through the notch and adapted to engage the notch edge.

Other embodiments of the invention provide a platform assembly that is connectable to a secondary structure. The platform assembly includes a first platform element having a substantially planar panel and a receptacle formed on an underside of the panel. The receptacle includes a substantially cylindrical tube having an inner periphery and at least a first engaging structure and a second engaging structure. The first and second engaging structures are formed on the inner periphery of the tube and are spaced from one another by an arc angle between 120° and 180°, as measured with respect to the tube. The platform assembly further includes a clip that is adapted to be stored within the receptacle. The clip has a base portion and a plurality of upstanding engagement elements. The engagement elements define a channel that is adapted to connect the first platform element to the secondary structure. The first engaging structure and the second engaging structure of the receptacle are adapted to engage the base portion of the clip to maintain the clip in a fixed position with respect to the panel. The base portion of the clip may have a length that is substantially equal to a chord distance that is defined between the first and second engaging structures. Furthermore, the arc angle may be between 150° and 170°, or the arc angle may be substantially equal to 160°.

BRIEF DESCRIPTION OF THE DRAWINGS

The description herein makes reference to the accompanying drawings, wherein like-referenced numerals refer to like parts throughout several views and wherein.

DESCRIPTION OF THE PREFERRED EMBODIMENT

Figure 1:
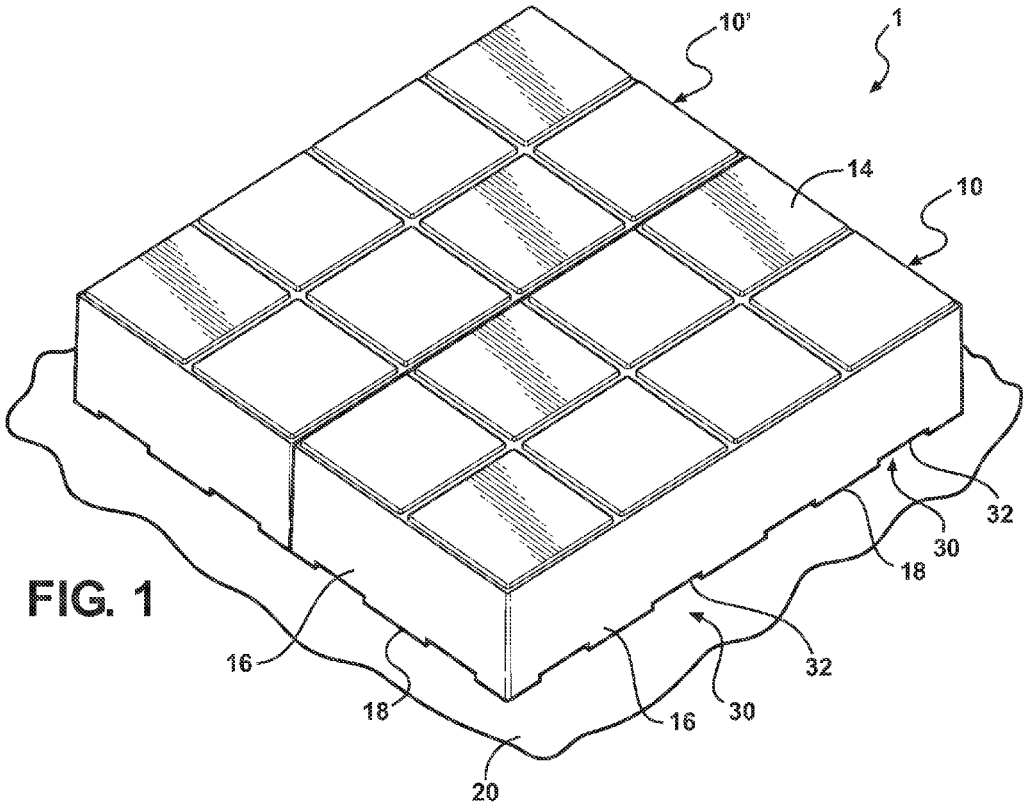
FIG. 1 is a top perspective view of a platform assembly according to the present invention.

Referring to the drawings, the present invention will now be described in detail with reference to the disclosed embodiment.

Figure 2:
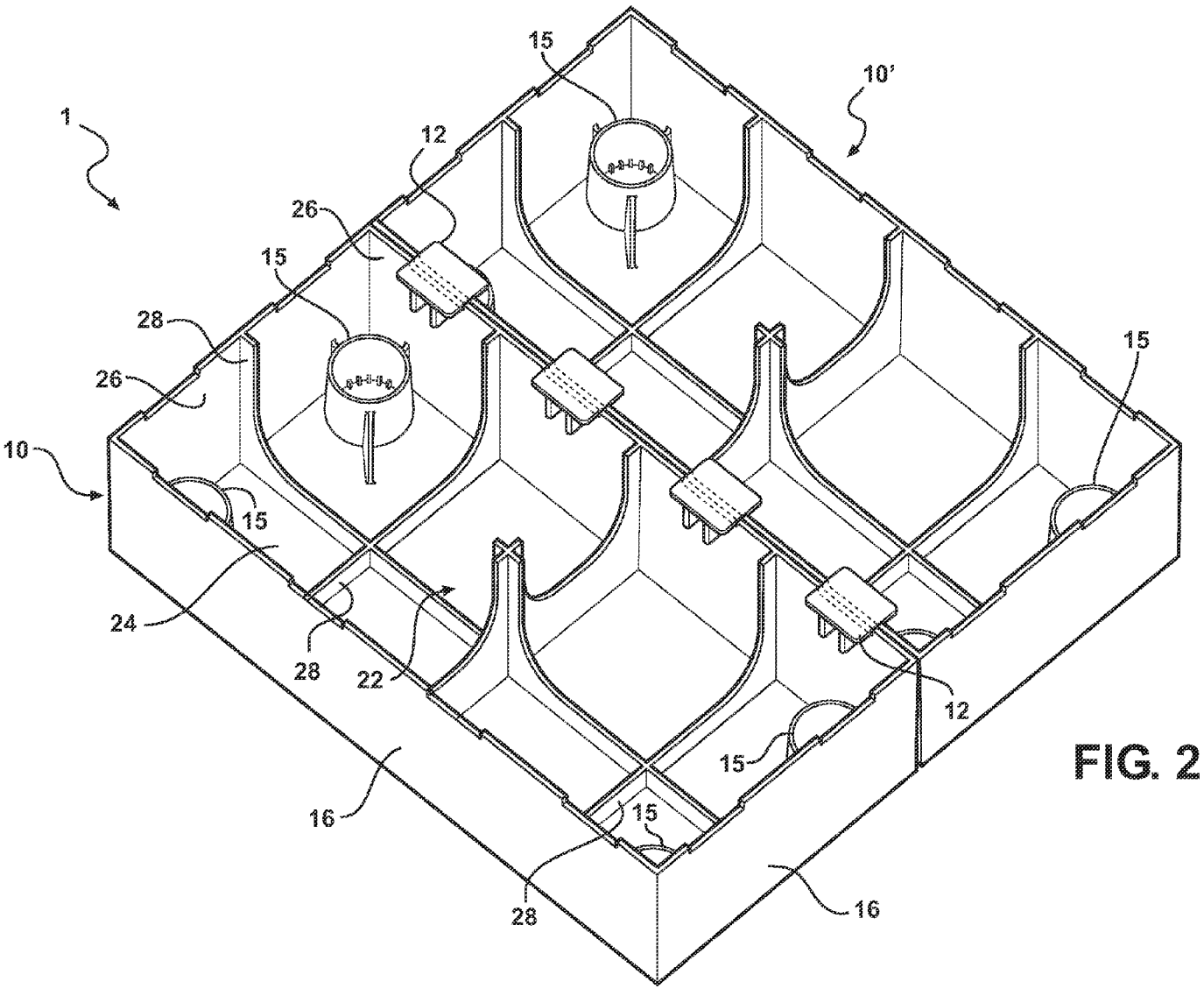
FIG. 2 is a bottom perspective view of the platform assembly according to the present invention.

FIGS. 1-2 show a platform assembly 1 that includes a platform element 10 that is adapted to be connected to one or more secondary structures 10'. The secondary structure 10' may be substantially identical to the platform element 10 or may be a platform or other structure that is adapted to be connected to the platform element 10. The platform assembly 1 further includes one or more clips 12 to interconnect the platform element 10 and the secondary structure 10'. The clips 12 are adapted to be installed in a storage position or a use position with respect to the platform element 10.

The platform element 10 may be fabricated from a strong, lightweight plastic material and includes a substantially planar top panel 14 and one or more generally-upstanding walls 16. The upstanding walls 16 are connected to the top panel 14 of the outer periphery thereof. The upstanding walls 16 extend generally downward from the top panel 14 and terminate at lower edges 18. The upstanding walls 16 of the platform element 10 may all extend substantially perpendicular both to the top panel 14 as well as to each other, such that the top panel 14 and the upstanding walls 16 define a substantially rectangular, five-sided structure for the platform element 10.

The top panel 14 and the upstanding walls 16 cooperate to define an internal cavity 22 of the platform element 10 that is open to the exterior of the platform element 10 and faces the floor surface 20. The internal cavity 22 is bounded by an underside 24 of the top panel 14, as well as by interior surfaces 26 of the upstanding walls 16. A plurality of support ribs 28 may be provided on the underside 24 of the top panel 14 and on the interior surfaces 26 of the upstanding walls 16 to increase the rigidity of the platform element 10.

The platform element 10 is configured so that it may be disposed in direct contact with a floor surface 20 or other external support surface. To support the platform element 10 with respect to the floor surface 20, the lower edges 18 of the upstanding walls 16 are adapted to engage the floor surface 20 to space the top panel 14 of the platform element 10 from the floor surface 20. To prevent the clips 12 from spacing the lower edges 18 from the floor surface 20, notches 30 may be provided along the lower edges 18 of the upstanding walls 16 of the platform element 10 to provide clearance for the clips 12. The notches 30 define notch edges 32 that remain spaced from the floor surface 20 when the lower edges 18 of the platform element 10 are engaged with the floor surface 20. The clearance provided between the lower edges 18 and the notch edges 32 by the notches 30 is sufficient to allow at least a portion of the clips 12 to extend through each notch 30 between the notch edge 32 and the floor surface 20 when the clips 12 are in the use position.

Figure 3:
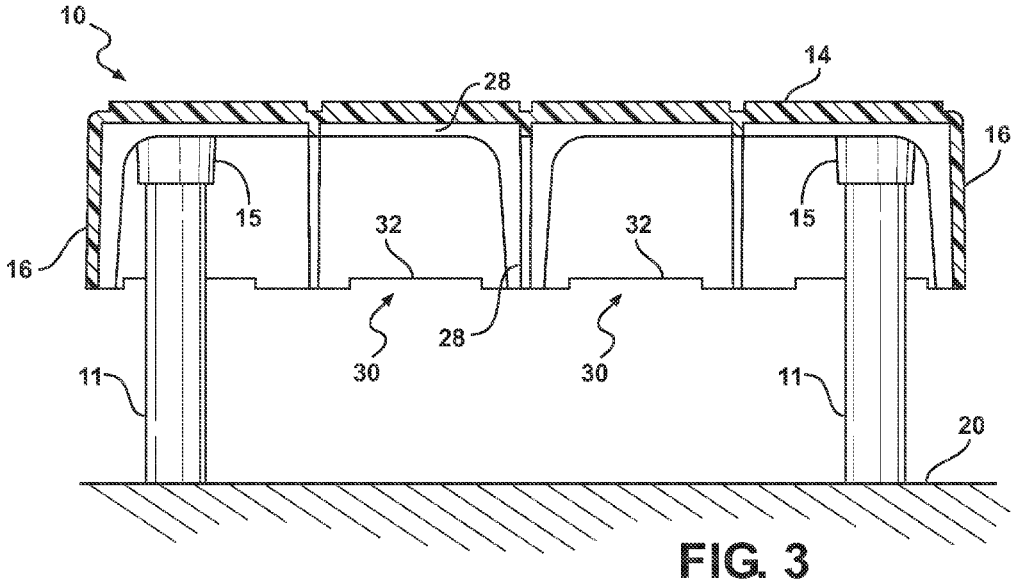
FIG. 3 is a side cross section view of a platform element of the platform assembly according to the present invention.

The platform element 10 is also configured so that it may be disposed at various heights, wherein the lower edges 18 of the platform element 10 are spaced from the floor surface by providing legs 11 that are received within tubular receptacles 15, as shown in FIG. 3. The receptacles 15 are formed on the underside 24 of the top panel 14 of the platform element 10. The legs 11 and the receptacles 15 are both substantially cylindrical, and an outer diameter of the legs 11 is substantially equal to an inner diameter of the receptacles 15, such that the legs 11 may be received within the receptacles 15 by a friction fit. Furthermore, projections 52 may be radially arrayed around an inner periphery 50 of the receptacles 15 and extend axially downward from the underside 24 of the top panel 14 to engage the upper ends of the legs 11 to slightly space the upper ends of the legs 11 from the underside 24 of the platform elements 10.

Figure 4:
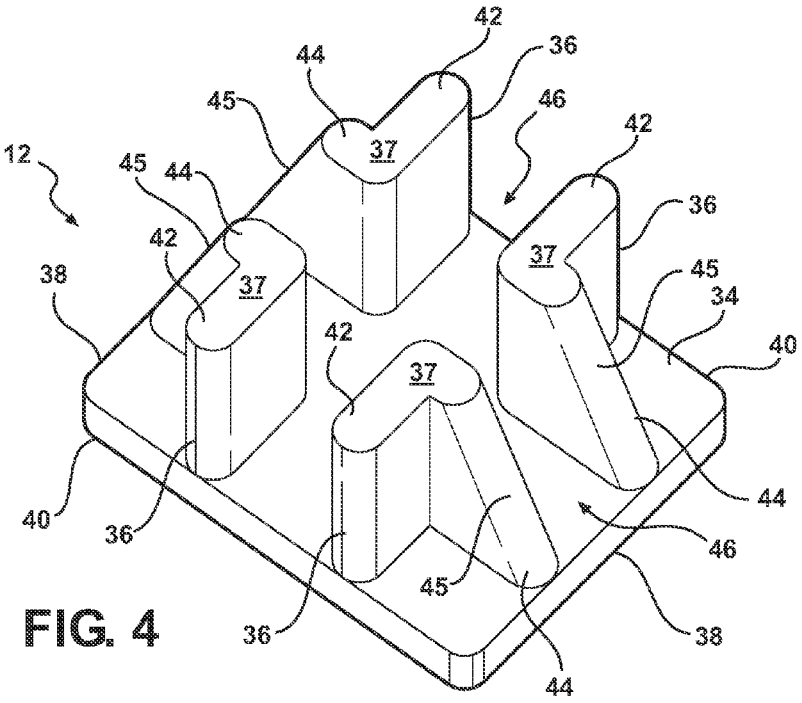
FIG. 4 is a perspective view showing a clip of the platform assembly according to the present invention.

As shown in FIG. 4, the clip 12 is formed by a plurality of interconnected flanges, namely a base portion 34 and a plurality of L-shaped engaging structures 36. The base portion 34 is a substantially rectangular member that is bounded by a pair of short edges 38 and a pair of long edges 40. Each engaging structure 36 includes a straight leg 42 that extends substantially parallel to the short edges 38 of the base portion 34 and a tapered leg 44 that extends substantially parallel to the long edges 40 of the base portion 34. The straight leg 42 and the tapered leg 44 of each of the engaging structures 36 meet near the center of the base portion 34. The tapered legs 44 of the engaging structures 36 include tapered edges 45 that extend upwardly and inwardly away from the short edges 38 of the base portion 34 toward a top surface 37 of each engaging structure, such that the largest cross-sectional area of each tapered leg 44 is located adjacent to the base portion 34, and the cross-sectional area of each tapered leg 44 is located adjacent to the top surface 37 thereof. The engaging structures 36 are spaced from one another by a pair of channels 46 that are defined by the engaging structures 36. The channels 46 extend substantially perpendicular with respect to one another in a plus-shaped configuration and are sized and configured to receive the upstanding wall 16 of the platform element 10 as well as a portion of the secondary structure 10' when the clips are in the use position.

Figure 5:
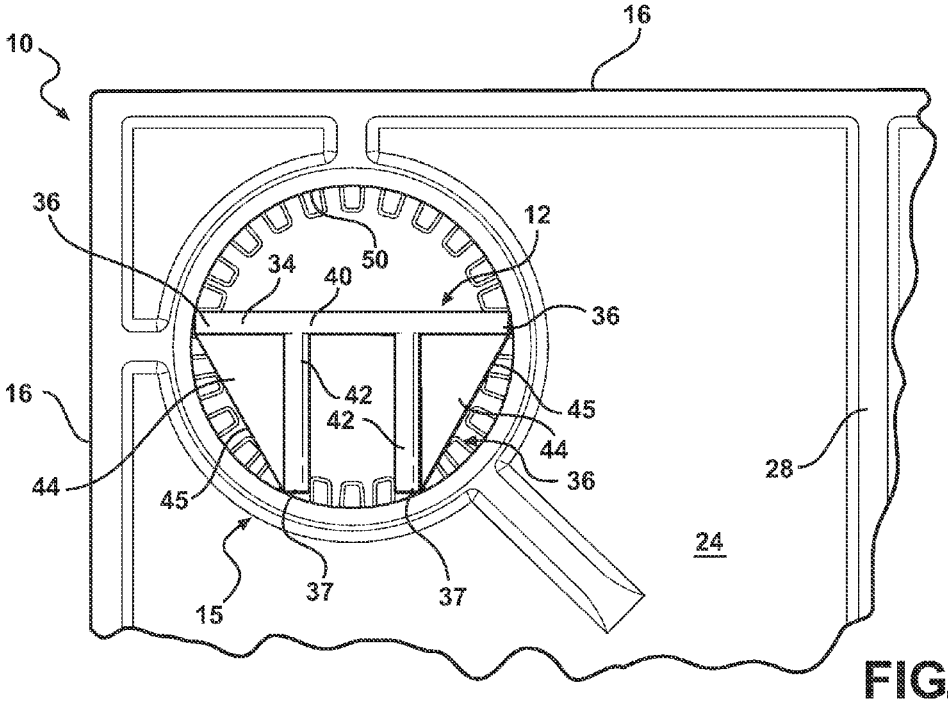
FIG. 5 is a detail view showing the clip disposed within a receptacle of the platform assembly according to the present invention.

As shown in FIG. 5, the clips 12 and the receptacles 15 of the platform element 10 are cooperatively sized and configured so that the clips 12 can be stowed within the receptacles 15 in the storage position when they are not in use. Each clip 12 is adapted to be received in a respective receptacle 15 such that the base portion 34 of the clip 12 extends substantially perpendicular to the top panel 14 of the platform element 10 with one of the long edges 40 of the base portion 34 disposed adjacent to and abutting the underside 24 of the top panel 14. Also, when the clip 12 is disposed within the receptacle 15, the straight legs 42 of the engaging structures 36 extend substantially perpendicular to the top panel 14 of the platform element 10, and the tapered legs 44 of the engaging structures 36 extend substantially parallel to the top panel 14 of the platform element 10. Furthermore, the short edges 38 of the base portion 34 and the top surfaces 37 of the engaging structures 36 are all disposed adjacent to and abutting the inner periphery 50 of the receptacle 15.

Figure 6:
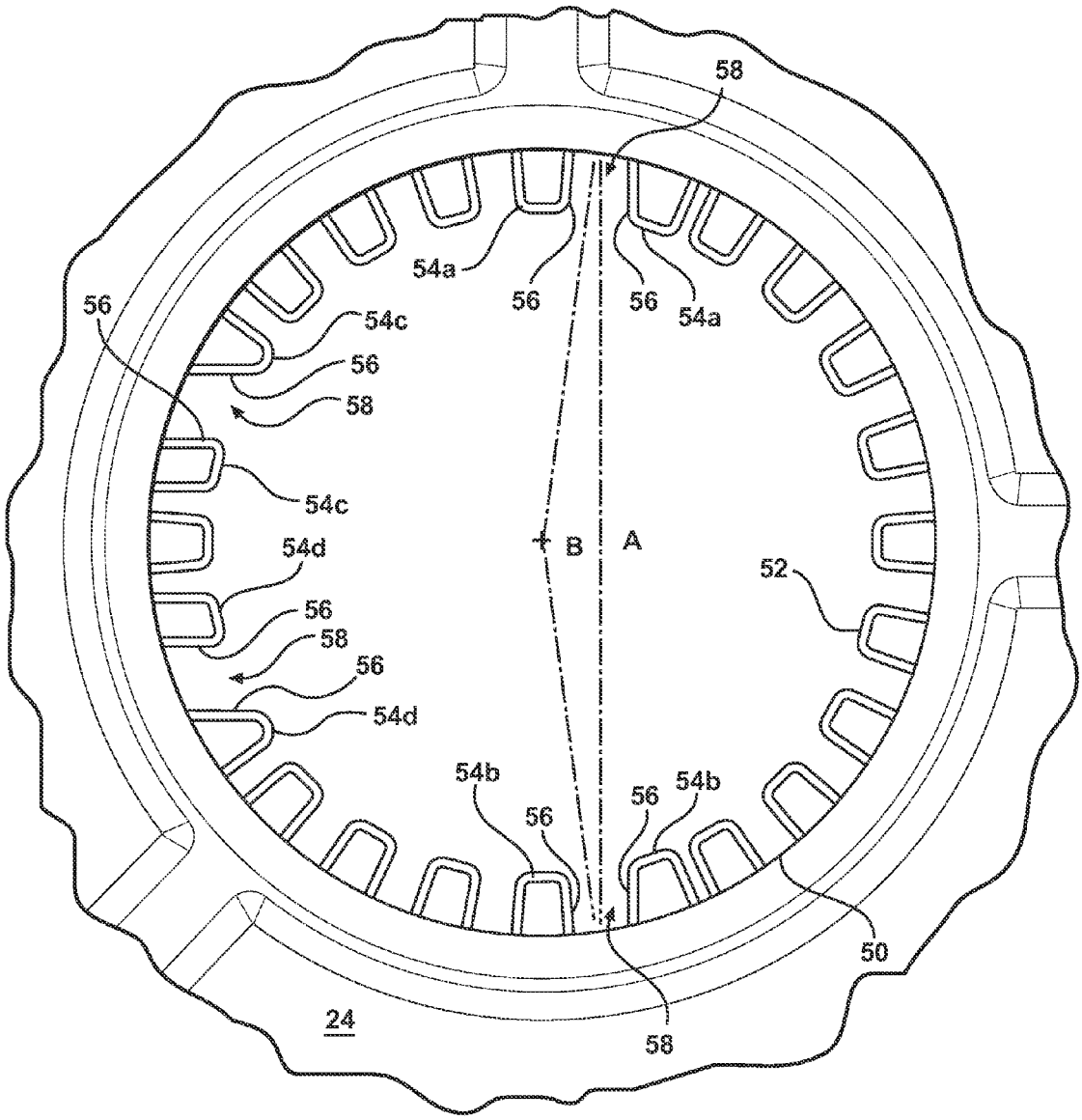
FIG. 6 is a detail view of the receptacle.

The receptacles 15 provide structures that are adapted to engage the clips 12 to maintain the clips 12 in a fixed position with respect to the top panel 14 of the platform element 10 when the clips 12 are in the storage position. For example, as seen in FIG. 6, the projections 52 may include pairs of fingers 54*a*-54*d* that have inner sides 56 that are substantially parallel to one another and are spaced from each other to receive the clips in spaces 58 formed between the inner sides 56 and to frictionally engage the clips 12 to retain the clips 12 in the storage position. In particular, a first pair of fingers 54*a* and a second pair of fingers 54*b* are adapted to engage the base portion 34 of the clips 12. The first pair of fingers 54*a* is formed opposite the second pair of fingers 54*b* by a chord distance A that is substantially equal to the length of the long edges 40 of the base portion 34 of each of the clips 12 and equal to or less than the outer diameter of the receptacles 15. The first and second pairs of fingers 54*a*, 54*b* are spaced from one another by an arc angle B measured with respect to the center of the receptacles 15 that is substantially between 120 degrees and 180 degrees and is more preferably between 150 and 170 degrees, given that an arc angle of substantially 160 degrees corresponds to a geometric shape for the clips 12 that provides excellent stability and engagement qualities. A third pair of fingers 54*c* and a fourth pair of fingers 54*d* are adapted to engage the engaging structures 36 of the clips 12.

Figure 7:
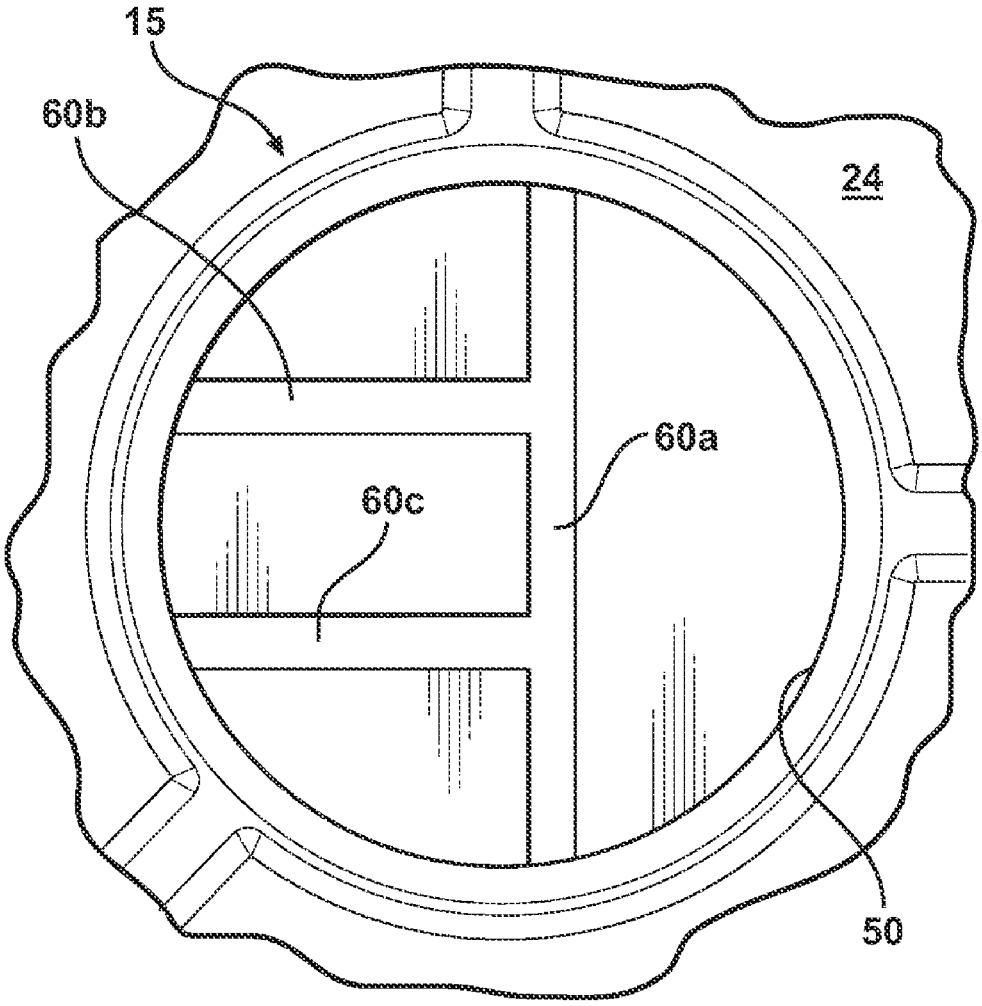
FIG. 7 is a detail view of an alternative receptacle.

It should be understood that while the fingers 54*a*-54*d* are described as engaging and retaining the clips 12, the invention is not limited to the fingers 54*a*-54*d* as the sole structures capable of engaging the clips 12. Rather, the fingers 54*a*-54*d* could be replaced with any structure capable of resiliently engaging, frictionally engaging, or otherwise retaining the clips 12. As an example, as shown in FIG. 7, the receptacles 15 may include channels 60*a*-60*c* that are adapted to maintain the clips 12 in a fixed position with respect to the top panel 14 of the platform element 10 when the clips 12 are in the storage position. The channels 60*a*-60*c* are from on or recessed into the underside 24 of the top panel 14 of the platform element 10. A first channel 60*a* is adapted to receive and frictionally engage one of the long edges 40 of one of the clips 12 therein. A second channel 60*b* and a third channel 60*c* are adapted to receive and frictionally engage respective ones of the straight legs 42 of one of the clips 12 therein. As another example, channels (not shown) could be provided axially on the inner periphery 50 of each receptacle 15.

In use, a user connects the platform element 10 to the secondary structure 10' using one or more of the clips 12 by placing the clips in the use position with respect to the platform element 10. When the platform element 10 is not connected to the secondary structure 10', the clip 12 may be placed in one of the receptacles 15, in the storage position.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

What is claimed is:

1. A platform assembly, comprising:

a platform element having a substantially planar panel, at least one upstanding wall that extends generally downward from the panel and is adapted to space the panel from an external support surface, and a receptacle formed on an underside of the panel;

a secondary structure; and a clip that is configured to be installed in a storage position and a use position with respect to the platform element, wherein the clip connects the upstanding wall to the secondary structure by engaging the upstanding wall and the secondary structure when the clip is in the use position, and the clip is disposed within the receptacle and engages the receptacle to maintain the clip in a fixed position with respect to the panel when the clip is in the storage position.

2. The platform element of claim 1, further comprising:

the clip having at least one flange formed thereon; and the receptacle having a pair of fingers, wherein the flange and the pair of fingers are configured such that the flange frictionally engages the pair of fingers when the clip is in the storage position.

3. The platform element of claim 1, further comprising:

the clip having at least one flange formed thereon; and the receptacle having a channel, wherein the flange and the channel are configured such that the flange frictionally engages the channel when the clip is in the storage position.

4. The platform assembly of claim 1, further comprising:

the receptacle having a tube connected to the underside of the panel, wherein the clip is disposed within the tube when the clip is in the storage position.

5. The platform element of claim 1, wherein the receptacle is configured to receive a leg therein to space the upstanding walls of the first platform element from the external support surface.

6. The platform element of claim 1, further comprising:

the upstanding wall having a lower edge that is configured to be engageable with the external support surface.

7. The platform element of claim 6, further comprising:

the upstanding walls of the first and second platform elements each having a notch formed along the lower edge thereof to define a notch edge that is spaced form the external support surface when the lower edge is engaged with the external support surface, wherein the clip extends through the notch and engages the notch edge when the clip is in the use position.

8. A platform assembly, comprising:

a first platform element having a substantially planar panel and an upstanding wall extending generally downward from the panel, wherein the upstanding wall is configured such that the panel is spaced from an external support surface;

a second platform element having a substantially planar panel and an upstanding wall extending generally downward from the panel, wherein the upstanding wall is configured such that the panel is spaced from the external support surface;

a clip that is configured for connection to the first platform element to define a storage position and is configured for connection to the first platform element and the second platform element to define a use position with respect to the platform, wherein the clip engages the upstanding walls of the first platform and the second platform to hold the upstanding walls in a fixed relationship with respect to one another when the clip is in the use position; and a receptacle formed on an underside of the panel of the first platform element, wherein the clip is disposed within the receptacle when the clip is in the storage position and the receptacle engages the clip to maintain the clip in a fixed position with respect to the panel when the clip is in the storage position.

9. The platform assembly of claim 8, further comprising:

the clip having at least one flange formed thereon; and the receptacle having a pair of fingers, wherein the flange and the pair of fingers are configured such that the flange frictionally engages the pair of fingers when the clip is in the storage position.

10. The platform assembly of claim 8, further comprising:

the clip having at least one flange formed thereon; and the receptacle having a channel, wherein the flange and the channel are configured such that the flange frictionally engages the channel when the clip is in the storage position.

11. The platform assembly of claim 8, further comprising:

the receptacle having a tube connected to the underside of the panel, wherein the clip is disposed within the tube when the clip is in the storage position.

12. The platform element of claim 8, further comprising:

the upstanding wall having a lower edge that is configured to be engageable with the external support surface.

13. The platform assembly of claim 12, wherein the receptacle is configured to receive a leg therein to space the upstanding walls of the first platform element from the external support surface.

14. The platform assembly of claim 8, further comprising:

the upstanding walls of the first and second platform elements each having a notch formed along the lower edge thereof to define a notch edge that is spaced from the external support surface when the lower edge is engaged with the external support surface, wherein the clip extends through the notch and engages the notch edge when the clip is in the use position.

15. A platform assembly that is connectable to a secondary structure, comprising:

a first platform element having a substantially planar panel and a receptacle formed on an underside of the panel, the receptacle including a substantially cylindrical tube having an inner periphery and at least a first engaging structure and a second engaging structure, the first and second engaging structures formed on the inner periphery of the tube and spaced from one another by an arc angle of between 120 and 180 degrees as measured with respect to the tube;

a clip that is adapted to be stored within the receptacle, the clip having a base portion and a plurality of upstanding engagement elements that define a channel that is adapted to connect the first platform element to the secondary structure, wherein the first engaging structure and the second engaging structure of the receptacle are adapted to engage the base portion of the clip to maintain the clip in a fixed position with respect to the panel; and wherein a chord distance is defined between the first and second engaging structures and the base portion of the clip has a length that is substantially equal to the chord distance.

16. The platform assembly of claim 15, wherein the arc angle is between 150 and 170 degrees.

17. The platform assembly of claim 15, wherein the arc angle is substantially equal to 160 degrees.

* * * * *